US011377717B2

(12) United States Patent
Guesser et al.

(10) Patent No.: US 11,377,717 B2
(45) Date of Patent: Jul. 5, 2022

(54) VERMICULAR CAST IRON ALLOY AND INTERNAL COMBUSTION ENGINE HEAD

(71) Applicant: TUPY S.A., Joinville (BR)

(72) Inventors: Wilson Luiz Guesser, Joinville (BR); Andre Koerich Ramos, Joinville (BR); Carlos de Souza Cabezas, Joinville (BR); Hector Mancha Molinar, Coahuila (MX)

(73) Assignee: Tupy S.A., Joinville-SC (BR)

( * ) Notice: Subject to any disclaimer, the term of this patent is extended or adjusted under 35 U.S.C. 154(b) by 448 days.

(21) Appl. No.: 16/331,175

(22) PCT Filed: Sep. 13, 2017

(86) PCT No.: PCT/BR2017/050271
§ 371 (c)(1),
(2) Date: Mar. 7, 2019

(87) PCT Pub. No.: WO2018/049497
PCT Pub. Date: Mar. 22, 2018

(65) Prior Publication Data

US 2019/0256956 A1 Aug. 22, 2019

(30) Foreign Application Priority Data

Sep. 13, 2016 (BR) ..... 1020160211395

(51) Int. Cl.
*C22C 37/00* (2006.01)
*C22C 37/10* (2006.01)
*F02F 1/24* (2006.01)

(52) U.S. Cl.
CPC ..... *C22C 37/10* (2013.01); *C22C 37/00* (2013.01); *F02F 1/24* (2013.01)

(58) Field of Classification Search
CPC ..... C22C 37/10; C22C 33/08; C22C 37/04; C22C 38/44; C21C 1/08; C21C 1/10; F02F 1/24
(Continued)

(56) References Cited

U.S. PATENT DOCUMENTS 3,421,886 A 1/1969 Schelleng ..... 75/123
4,596,606 A 6/1986 Kovacs et al. ..... 148/3
(Continued)

FOREIGN PATENT DOCUMENTS

BR PI 0105987-4 8/2009
BR PI 0105989-0 8/2009
(Continued)

OTHER PUBLICATIONS

Dawson, S., et al., "The Effect of Metallurgical Variables on the Machinability of Compacted Graphite Iron", Society of Automotive Engineers, Inc., 2001, 19 pages.
(Continued)

*Primary Examiner* — Long T Tran
*Assistant Examiner* — James J Kim
(74) *Attorney, Agent, or Firm* — Harrington & Smith

(57) ABSTRACT

The present invention relates to the technological field of cast iron alloys for automotive and similar applications. Problem to be solved: Presently, structural parts of internal combustion engines are made of gray cast iron alloys that rarely have a tensile strength limit range greater than 350 MPa or vermicular cast iron alloys that do not remain stable at high temperatures. Solution of the problem: It is disclosed a vermicular cast iron alloy that, due to the addition of amounts of Molybdenum, Copper and Tin, with Hot Resistance Factor from 0.5 to 1.7% (HRF=3×(% Mo)+1×(% Sn)+0.25×(% Cu)) achieves a tensile strength limit of 500 to
(Continued)

550 MPa at room temperature and up to 300° C., and a tensile strength limit of 430 to 450 MPa at 400° C.

4 Claims, 1 Drawing Sheet

(58) Field of Classification Search
USPC ..... 420/26
See application file for complete search history.

(56) References Cited

U.S. PATENT DOCUMENTS

| | | | | |
|---|---|---|---|---|
| 9,132,478 | B2 | 9/2015 | Muller et al. | 123/193.5 |
| 2003/0007882 | A1* | 1/2003 | Perrin | C22C 37/10 420/28 |
| 2007/0023106 | A1* | 2/2007 | Lampic-Oplander | C22C 37/10 420/26 |
| 2008/0274005 | A1* | 11/2008 | Liao | C22C 37/04 420/13 |
| 2014/0286819 | A1* | 9/2014 | Chung | C22C 37/10 420/26 |
| 2015/0299832 | A1* | 10/2015 | Kristan | C22C 38/22 148/333 |
| 2015/0368765 | A1* | 12/2015 | Zhang | C22C 38/04 148/541 |

FOREIGN PATENT DOCUMENTS

| | | |
|---|---|---|
| JP | S61-26754 | 2/1986 |
| JP | S62-139907 | 9/1987 |

OTHER PUBLICATIONS

Dawson, Steve, "Compacted graphite iron—A material solution for modern diesel engine cylinder blocks and heads", Overseas Foundry, Aug. 2009, pp. 241-246.

Dawson, J.V., FIBF, "Vanadium in cast iron", 1982 UK International Exchange Paper, 1982, 16 pages.

BCIRA Broadsheet 228, "Vanadium in cast irons", BCIRA, 1983, 3 pages.

* cited by examiner

VERMICULAR CAST IRON ALLOY AND INTERNAL COMBUSTION ENGINE HEAD

CROSS REFERENCE TO RELATED APPLICATION

This patent application is a U.S. National Stage application of International Patent Application Number PCT/BR2017/050271 filed Sep. 13, 2017, which is hereby incorporated by reference in its entirety, and claims priority to BR 1020160211395 filed Sep. 13, 2016.

FIELD OF THE INVENTION

The present invention relates to a novel vermicular cast iron alloy, designed for the manufacture of internal combustion engine heads and, more particularly, a vermicular cast iron alloy which, having special requirements for high temperatures mechanical properties, is especially suitable for the manufacture of high efficiency internal combustion engine heads.

The invention in question also relates to the internal combustion engine head, made with the vermicular cast iron alloy as disclosed herein.

FUNDAMENTALS OF THE INVENTION

As is well known to those skilled in the art, internal combustion engines comprise machines skilled in transforming energy from a chemical reaction into usable mechanical energy. In general, the process of energy conversion occurs as a function of the controlled manipulation of the physical-chemical features of a fuel, which undergoes modifications in volume, pressure and temperature. Of course, the controlled manipulation of the physicochemical features of the fuel takes place inside a controlled environment, that is, inside the internal combustion engine itself. In this sense, it is known that the controlled environment of the internal combustion engines, especially those applied in automotive vehicles, is defined in the volume resulting from the joining of structural parts commonly known as engine block and engine head.

This means that the construction material of these structural parts directly influences the efficiency of the internal combustion engine as a whole, after all, such manufacturing material must bring together special features, which make these structural parts capable of withstanding modifications in volume, pressure and fuel temperature.

Thus, it is noted that the demand for high mechanical strength casting materials has been intense by the automotive industry, aiming at increasing engine power.

In any case, it is well known to those skilled in the art that structural parts of internal combustion engines are often made of high strength gray cast iron or high strength vermicular cast iron.

An example of a gray cast iron alloy especially used for the manufacture of internal combustion engine heads is described in the patent document U.S. Pat. No. 9,132,478. Such document describes a lamellar gray cast iron alloy, consisting essentially of the addition of carbon (2.80% to 3.60%), silicon (1.00% to 1.70%), manganese (0.10% to 1,20%), sulfur (0.03% to 0.15%), chromium (0.05% to 0.30%), molybdenum (0.05% to 0.30%) and tin (0.05% to 0.20%) in the cast iron, the structural matrix of the alloy being constructed with a maximum of 5% of ferrite. Although the gray cast iron alloy described in the patent document U.S. Pat. No. 9,132,478 contains high contents of molybdenum, which is favorable to providing good mechanical properties, it is still related to a gray cast iron and, therefore, with limited strength values of at most 350 MPa.

It is also known other gray cast iron alloys with addition of chromium and molybdenum, with reasonable values of hot strength. However, the increase in the temperature of the combustion gases in the new engines shows that such technique is no longer adequate for new situations. The increase of the molybdenum content for up to 0.35% partially solves the problem, increasing to a certain extent the hot resistance, without, however, applying a definitive solution, because it is restricted to a maximum of 350 MPa of resistance limit, limit value for the gray cast iron.

This means that known gray cast iron alloys rarely have a tensile strength limit range greater than 350 MPa, which limits the use of this conceptual alloy type for the manufacture of structural parts of internal combustion engines with higher mechanical stress levels.

As far as vermicular cast iron alloys are concerned, Guesser et al. (evaluation of the machinability of vermicular cast iron through drilling tests, published at the $6^{th}$ Brazilian congress of manufacturing engineering held from Apr. 11 to 15, 2011, in Caxias do Sul, RS, Brazil) teaches that vermicular cast iron, which was obtained by chance during the manufacture of nodular cast iron, due to errors of chemical composition, has been part of the prior art since mid-1965, as described in the patent document U.S. Pat. No. 3,421,886. From a conceptual point of view, vermicular cast iron is characterized by the fact that it comprises worm-shaped graphite (elongated and randomly oriented form, with rounded ends) arranged in a pearlitic or even ferritic/pearlitic matrix.

The first vermicular cast iron alloy, as described in the patent document U.S. Pat. No. 3,421,886, is essentially composed of the addition of carbon (2% to 4%), silicon (1.5% to 3.5%), nickel (about 36%), magnesium (0.005% to 0.06%), one of the metals in group 3B of the periodic table (0.001% to 0.015%) and titanium (0.15% to 0.5%) in cast iron, being the magnesium the metal from group 3B of the periodic table and titanium, effective to control the occurrence of graphite in vermicular form (at least 50%) in cast iron. This amount of vermicular graphite, today, is no longer accepted by the international standards of blocks and engine heads, which establish a minimum of 80% of vermicular graphite.

Of course, the vermicular cast iron alloys have evolved over the years, according to the multiple and different desired applications.

An example of vermicular cast iron alloy for automotive applications is described in the patent document PI 0105987-4. Such document describes a vermicular cast iron alloy consisting essentially of the addition of carbon (3.5% to 3.8%), silicon (2.0% to 2.6%), chromium (less than 0.05%), manganese (less than 0.40%) and titanium (less than 0.015%) in cast iron, with chromium, manganese and titanium being effective to control the occurrence of 10 to 13% of predominantly vermicular graphite and up to 20% of predominantly nodular graphite in the microstructure of the cast iron, which is free of lamellar graphite. Additionally, it is further verified that the vermicular cast iron alloy disclosed in the patent document PI 0105987-4 comprises a microstructure whose metal matrix is composed of ferrite and pearlite, the pearlite ratio being equal to or greater than 50%.

Although it is found that the vermicular cast iron alloy described in the patent document PI 0105987-4 has high mechanical properties at room temperature, it is noted that such properties do not remain stable at elevated temperatures, thus limiting the use of such alloy for the manufacture of structural parts of internal combustion engines operating at high temperatures.

Another example of ferrous alloy for automotive applications is described in the patent document JP 1986026754. Such document describes a cast iron alloy (which may be malleable cast iron, gray cast iron or vermicular cast iron) consisting essentially of the addition of carbon (2.5% to 4.0%), silicon (0.8% to 1.5%), manganese (0.3% to 1.5%), phosphorus (0.05% to 1.5%), sulfur (less than 0.3%), nickel (equal to or less than 0.5%), chromium (equal to or less than 1.5%), molybdenum (equal to or less than 0.8%), tin (equal to or less than 0.5%), copper (equal to or less than 4.0%) and zirconium (equal to or less than 1%) in cast iron. In particular, such cast iron alloy is especially used for the manufacture of double-walled cylinder liners of internal combustion engines.

The alloy disclosed in the patent document JP 1986026754 provides high resistance to hot wear, due to the formation of hard particles, such as chromium and molybdenum phosphides (hard and stable particles at high temperature). Such alloy has high phosphorus content (>0.05%), suitable for the formation of hard particles resistant to wear, in a simple geometric piece such as cylinder liners, but incompatible with the production of complex casting parts, such as engine heads, wherein the effect of the high content of phosphorus brings enormous difficulties of internal sanity, favoring the presence of micro shrinkage. Moreover, such alloy, in the same manner that occurs with traditional gray cast iron alloys, does not present high values of tensile strength, for example, above 500 MPa, because after all the presence of phosphides in the microstructure causes a decrease in the tensile strength, since these particles induce the formation of cracks in the matrix under mechanical stress, which is further aggravated by the presence of micro porosities originating from the high phosphorus content. In the specific case of wear applications, this fact does not represent a major problem, and such alloy is, therefore, suitable for cylinder liners, but for parts of complex geometry and in uses under high levels of mechanical stresses, this alternative does not represent a solution. It is, therefore, based on such scenario that the present invention arises.

Objectives of the Invention

Therefore, it is the main goal of the present invention to disclose a novel vermicular cast iron alloy with tensile strength limit of 500 to 550 MPa at room temperature and up to 300° C., and tensile strength limit of 430 to 450 MPa at 400° C.

It is also a goal of the present invention to disclose an internal combustion engine head which, made from the new vermicular cast iron alloy with a tensile strength limit of 500 to 550 MPa at room temperature and up to 300° C., and tensile strength limit of 430 to 450 MPa at 400° C., is able to withstand high operating temperatures and high levels of mechanical stress.

It is further a goal of the present invention to disclose an internal combustion engine head which, made from the new vermicular cast iron alloy with a tensile strength limit of 500 to 550 MPa at room temperature and up to 300° C., and tensile strength limit of 430 to 450 MPa at 400° C., is capable of optimizing the heat extraction conditions so important in internal combustion engines.

BRIEF DESCRIPTION OF THE DRAWINGS

The present invention will be described in greater detail based on the following figures, which.

DETAILED DESCRIPTION OF THE INVENTION

Figure 1:
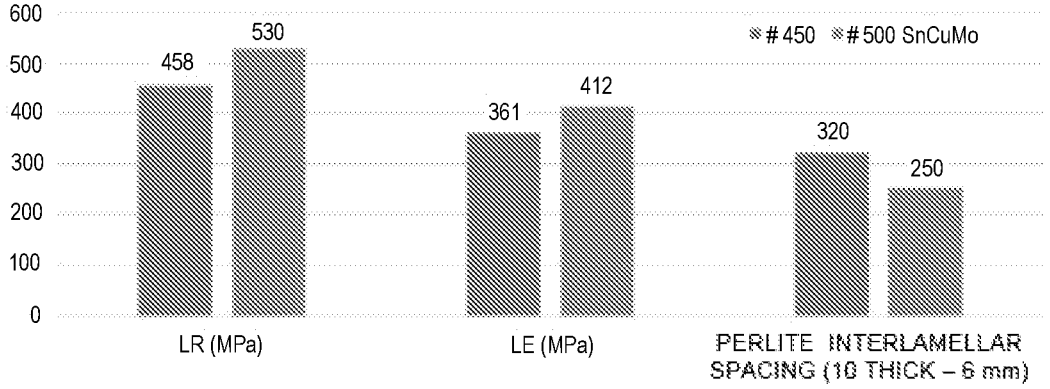
FIG. 1 illustrates graphics of mechanical properties results and microstructure of vermicular iron connected with Sn, Cu and Mo, compared to the conventional class #450. Block Y of 25 mm of thickness.

Thus, in order to achieve the above-mentioned technical objects and effects, it is described the vermicular cast iron alloy, according to the present invention.

In this sense, it is the general merit of the invention to add molybdenum, copper and tin in balanced and suitable proportions to the list of alloy elements already conventionally used in vermicular cast iron, without the addition of other elements capable of forming hard phosphides such as, for example, chromium associated with high levels of phosphorus (>0.05%) and others.

Among the possible alloy elements already used in vermicular cast iron, in their typical compositions and usual contents, such as carbon (3.0 to 3.9%), manganese (0.1 to 0.6%), silicon (1.5 to 3.0%), magnesium (0.005 to 0.030%), cerium (0.005 to 0.030%), and residual elements such as sulfur (less than 0.030%) and phosphorus (less than 0.050%), it is added to the vermicular cast iron alloy, object of the present invention: Molybdenum, Tin and Copper.

More particularly, such alloy elements are especially added in the following proportions:

Molybdenum, in a range of 0.05% to 0.40% of the total amount of the alloy.

Tin, in a range of 0.01% to 0.13% of the total amount of the alloy. Copper, in a range of 0.2% to 1.30% of the total amount of the alloy.

These quantities of molybdenum, copper and tin should be balanced, so that the Hot Resistance Factor (HRF) is between 0.5 to 1.7%. Such factor is defined here as:

$$HRF=3\times(\%\ Mo)+1\times(\%\ Sn)+0.25\times(\%\ Cu)\text{(percentages by weight)}$$

Obviously, the vermicular cast iron alloy, object of the present invention, may contain still further typical impurities of cast irons, which do not alter or impair the desired features.

As previously mentioned, said desired results—tensile strength limit of 500 to 550 MPa at ambient temperature and up to 300° C., and tensile strength limit of 430 to 450 MPa at 400° C.—are particularly achieved due to the addition of Molybdenum, Tin and Copper, in the aforementioned ranges and within the aforementioned Hot Resistance Factor. These additions of molybdenum, copper and tin may be carried out in the melting furnace, in the transport or pouring pan, in the pouring furnace, or in the pouring jet.

As a final result of the addition of the above-listed alloy elements, in the proportions given above, by means of the process explained above, a vermicular iron is obtained, whose microstructure comprises a fine pearlite matrix, with predominantly vermicular form graphite particles and with the presence of graphite nodules of up to 20%, being the average interlamellar spacing of the pearlite reduced, for example, in a block Y of 25 mm of thickness, from 0.32 μm to 0.25 μm, as illustrated in the FIG. 1.

Figure 2:
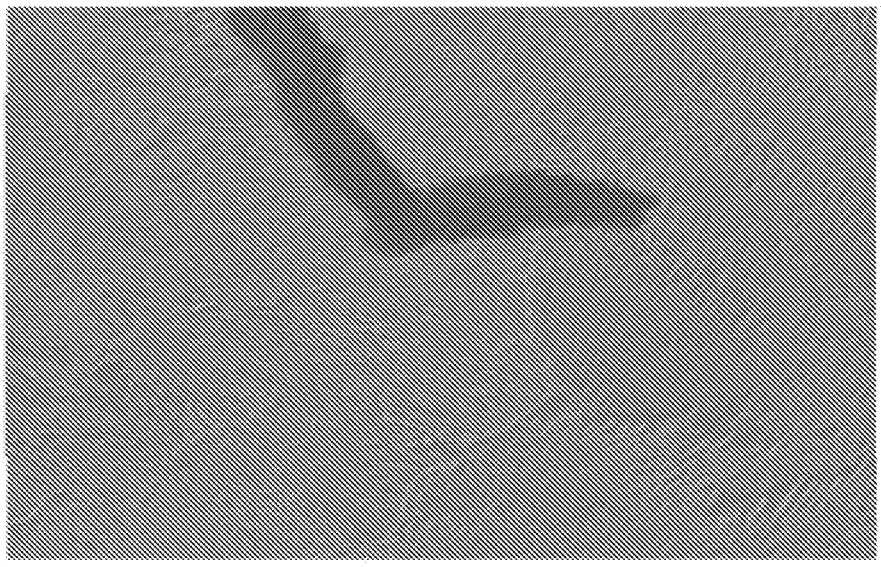
FIG. 2 illustrates the vermicular iron typical microstructure containing Sn, Mo and Cu, with HRF=1.15% (vermicular graphite particle and refined pearlite).

It is also worth highlighting that the decrease in the average interlamellar spacing of the pearlite (FIG. 2) comprises one of the main causes of the increase in mechanical strength of the vermicular cast iron alloy, object of the present invention.

Consequently, it becomes possible to manufacture an internal combustion engine head (and, incidentally, other structural parts of internal combustion engines) with said cast iron alloy containing the usual contents of carbon (3.0 to 3.9%), manganese (0.1 to 0.6%), silicon (1.5 to 3.0%), magnesium (0.005 to 0.030%), cerium (0.005 to 0.030%), and residual elements, such as sulfur (less than 0.030%) and phosphorus (less than 0.050%), being especially added Tin, in the range of 0.01 to 0.13% of the total amount of alloy, Copper, in a range of 0.2% to 1.3% of the total amount of the alloy, and Molybdenum, in a range of 0.05% to 0.40% of the total amount of the alloy, percentages expressed by weight. These quantities of molybdenum, copper and tin must be balanced, so that the Hot Resistance Factor (HRF) is between 0.5 to 1.7%. Such factor is defined by:

$$HRF=3\times(\%\ Mo)+1\times(\%\ Sn)+0.25\times(\%\ Cu)\text{(percentages by weight)}$$

In any case, the same features of the microstructure matrix of the vermicular cast iron alloy (fine pearlite matrix with graphite particles predominantly in vermicular form and presence of graphite nodules in up to 20%), as well as the results desired (tensile strength limit of 500 to 550 MPa at room temperature and up to 300° C. and tensile strength limit of 430 to 450 MPa at 400° C.) are fully present in the internal combustion engine head.

Consequently, these high values of hot strength allow a long life of the component and, alternatively, allows to revise the design of the dimension of the head, reducing section thicknesses, which also results in improved heat extraction conditions, important aspect in internal combustion engine heads.

This means that the invention in question enables the development of superior performance engine heads, suitable for high engine operating temperatures and high levels of mechanical stress.

The invention claimed is:

1. VERMICULAR CAST IRON ALLOY, containing the usual contents of the elements carbon (3.0 to 3.9%), manganese (0.1 to 0.6%), silicon (1.5 to 3.0%), magnesium (0.005 to 0.030%), cerium (0.005 to 0.030%) and residual elements such as sulfur (less than 0.030%) and phosphorus (less than 0.050%) are also present, characterized by the fact that it comprises a vermicular cast iron alloy with the following alloy elements, in their respective proportions:

Tin, existing in a range of 0.01% to 0.13% of the total amount of the alloy,

Copper, existing in a range of 0.2% to 1.3% of the total amount of the alloy, and Molybdenum, existing in a range of 0.05% to 0.40% of the total amount of the alloy;

these levels are balanced so that the Hot Resistance Factor (HRF) is between 0.5 and 1.7%, such factor defined by:

$$HRF=3\times(\%\ Mo)+1\times(\%\ Sn)+0{,}25\times(\%\ Cu)\text{(percentages by weight)}$$

wherein chromium is absent in the alloy, the matrix of the microstructure of said vermicular cast iron alloy comprises a fine pearlitic matrix comprising pearlite and with graphite particles predominantly in vermicular form and with the presence of graphite nodules up to 20%, and wherein an average interlamellar spacing of the pearlite is about 0.25 μm.

2. INTERNAL COMBUSTION ENGINE HEAD, containing the usual contents of the elements carbon (3.0 to 3.9%), manganese (0.1 to 0.6%), silicon (1.5 to 3.0%), magnesium (0.005 to 0.030%), cerium (0.005 to 0.030%), and residual elements such as sulfur (less than 0.030%) and phosphorus (less than 0.050%) are also present, characterized by the fact that it comprises the following alloy elements:

Tin, existing in a range of 0.01% to 0.13% of the total amount of the alloy,

Copper, existing in a range of 0.2% to 1.3% of the total amount of the alloy, and Molybdenum, existing in a range of 0.05% to 0.40% of the total amount of the alloy;

these levels are balanced so that the Hot Resistance Factor (HRF) is between 0.5 and 1.7%, such factor defined by:

$$HRF=3\times(\%\ Mo)+1\times(\%\ Sn)+0{,}25\times(\%\ Cu)\text{(percentages by weight)}$$

wherein chromium is absent in the alloy, the matrix of the microstructure of said vermicular cast iron alloy comprises a fine pearlitic matrix comprising pearlite and with graphite particles predominantly in vermicular form and with the presence of graphite nodules up to 20%, and wherein an average interlamellar spacing of the pearlite is about 0.25 μm.

3. VERMICULAR CAST IRON ALLOY, comprising at least the following alloy elements, in the respective proportions:

Carbon, existing in a range of 3.0% to 3.9% of the total amount of the alloy,

Manganese, existing in a range of 0.1% to 0.6% of the total amount of the alloy, Silicon, existing in a range of 1.5% to 3.0% of the total amount of the alloy, Magnesium, existing in a range of 0.00% to 0.030% of the total amount of the alloy, Cerium, existing in a range of 0.005% to 0.030% of the total amount of the alloy, Sulfur, existing in a range of less than 0,030% of the total amount of the alloy Phosphorus, existing in a range of less than 0.050% of the total amount of the alloy, said vermicular cast iron alloy being especially characterized by the fact that it further comprises the following alloy elements, in the respective proportions:

Tin, existing in a range of 0.01% to 0.13% of the total amount of the alloy,

Copper, existing in a range of 0.2% to 1.3% of the total amount of the alloy, and Molybdenum, existing in a range of 0.05% to 0.40% of the total amount of the alloy;

these levels are balanced so that the Hot Resistance Factor (HRF) is between 0.5 and 1.7%, such factor defined by:

$$HRF=3\times(\%\ Mo)+1\times(\%\ Sn)+0{,}25\times(\%\ Cu)\text{(percentages by weight)}$$

wherein chromium is absent in the alloy, the matrix of the microstructure of said vermicular cast iron alloy comprises a fine pearlitic matrix comprising pearlite and with graphite particles predominantly in vermicular form and with the presence of graphite nodules up to 20%, and wherein an average interlamellar spacing of the pearlite is about 0.25 μm.

4. INTERNAL COMBUSTION ENGINE HEAD, being characterized by the fact that it is made of a vermicular cast iron alloy comprising the following alloy elements, in the respective proportions:

Carbon, existing in a range of 3.0% to 3.9% of the total amount of the alloy,

Manganese, existing in a range of 0.1% to 0.6% of the total amount of the alloy, Silicon, existing in a range of 1.5% to 3.0% of the total amount of the alloy, Magnesium, existing in a range of 0.00% to 0.030% of the total amount of the alloy, Cerium, existing in a range of 0.005% to 0.030% of the total amount of the alloy, Sulfur, existing in a range of less than 0,030% of the total amount of the alloy Phosphorus, existing in a range of less than 0.050% of the total amount of the alloy, Tin, existing in a range of 0.01% to 0.13% of the total amount of the alloy, Copper, existing in a range of 0.2% to 1.3% of the total amount of the alloy, and Molybdenum, existing in a range of 0.05% to 0.40% of the total amount of the alloy;

these levels are balanced so that the Hot Resistance Factor (HRF) is between 0.5 and 1.7%, such factor defined by:

$$HRF=3\times(\%\ Mo)+1\times(\%\ Sn)+0{,}25\times(\%\ Cu)\text{(percentages by weight)}$$

wherein chromium is absent in the alloy, the matrix of the microstructure of said vermicular cast iron alloy comprises a fine pearlitic matrix comprising pearlite and with graphite particles predominantly in vermicular form and with the presence of graphite nodules in up to 20%, and wherein an average interlamellar spacing of the pearlite is about 0.25 μm.

* * * * *